US007334290B2

(12) United States Patent
Hawkins et al.

(10) Patent No.: US 7,334,290 B2
(45) Date of Patent: Feb. 26, 2008

(54) UPRIGHT VACUUM CLEANER WITH CYCLONIC AIR PATH

(75) Inventors: Thomas Hawkins, Normal, IL (US); Rich Eisenmenger, Champaign, IL (US); Len Hampton, Normal, IL (US); Christer Kontio, Bloomington, IL (US)

(73) Assignee: Electrolux Home Care Products, Inc., Cleveland, OH (US)

( * ) Notice: Subject to any disclaimer, the term of this patent is extended or adjusted under 35 U.S.C. 154(b) by 0 days.

(21) Appl. No.: 11/758,824

(22) Filed: Jun. 6, 2007

(65) Prior Publication Data

US 2007/0226951 A1 Oct. 4, 2007

Related U.S. Application Data

(63) Continuation of application No. 11/281,796, filed on Nov. 18, 2005, now Pat. No. 7,228,592, which is a continuation of application No. 10/430,603, filed on May 6, 2003, now abandoned, which is a continuation of application No. 09/759,391, filed on Jan. 12, 2001, now Pat. No. 6,910,245.

(60) Provisional application No. 60/176,374, filed on Jan. 14, 2000.

(51) Int. Cl.
*A47L 9/16* (2006.01)

(52) U.S. Cl. ..... 15/352; 15/350; 15/353; 55/DIG. 3; 55/337; 55/429

(58) Field of Classification Search ..... 15/319, 15/339, 350, 352, 353; 55/337, 345, 429, 55/DIG. 3

See application file for complete search history.

(56) References Cited

U.S. PATENT DOCUMENTS

| | | | | | |
|---|---|---|---|---|---|
| 3,320,727 | A | * | 5/1967 | Farley et al. | 55/337 |
| 4,199,838 | A | * | 4/1980 | Simonsson | 15/339 |
| 4,373,228 | A | * | 2/1983 | Dyson | 15/350 |
| 4,733,430 | A | * | 3/1988 | Westergren | 15/339 |
| 4,733,431 | A | * | 3/1988 | Martin | 15/339 |
| 5,023,973 | A | * | 6/1991 | Tsuchida et al. | 15/319 |
| 5,230,722 | A | * | 7/1993 | Yonkers | 55/337 |
| 5,542,146 | A | * | 8/1996 | Hoekstra et al. | 15/319 |
| 6,026,539 | A | * | 2/2000 | Mouw et al. | 15/339 |

(Continued)

FOREIGN PATENT DOCUMENTS

JP 58-54255 4/1983

*Primary Examiner*—Theresa T. Snider
(74) *Attorney, Agent, or Firm*—Hunton & Williams

(57) ABSTRACT

An upright suction cleaner having a base, a body pivotally mounted on the base, a suction device, and a dirt separation system. The dirt separation system has a first and second dirt separators. the first of which may include an air-pervious shroud having a plate extending from it. An airflow path extends from the base, through the separation system, and into the suction device. A dirt collecting system is mountable to the body, and includes a first chamber to receive dirt separated by the first dirt separator, and a second chamber to receive dirt separated by the second dirt separator. The chambers are adjacent one another when mounted to the body. A tube forming part of the airflow path between the dirt separation system and the suction device is selectively mountable adjacent the dirt collecting system. An elevator assembly is provided to attach the dirt collecting system to the body.

25 Claims, 8 Drawing Sheets

U.S. PATENT DOCUMENTS 6,026,540 A * 2/2000 Wright et al. ..... 15/347
6,375,696 B2 4/2002 Wegelin et al.
6,385,810 B1 5/2002 Lang
6,408,481 B1 * 6/2002 Dyson ..... 15/350
6,589,309 B2 7/2003 Oh et al.
6,640,385 B2 11/2003 Oh et al.
6,732,406 B2 5/2004 Oh
6,735,816 B2 5/2004 Oh et al.
6,735,818 B2 5/2004 Hamada et al.
6,757,933 B2 7/2004 Oh et al.
6,782,584 B2 8/2004 Choi
6,836,931 B2 1/2005 Bone
6,910,245 B2 * 6/2005 Hawkins et al. ..... 15/339
6,922,868 B1 8/2005 Jeong
6,991,667 B2 1/2006 Yang et al.
7,055,211 B2 6/2006 Tucker
7,152,274 B2 12/2006 Alford et al.
7,155,772 B2 1/2007 Lee
7,191,490 B2 3/2007 Lee et al.
7,228,592 B2 * 6/2007 Hawkins et al. ..... 15/353
2004/0261216 A1 12/2004 Choi et al.
2005/0138760 A1 6/2005 Park et al.
2005/0138761 A1 6/2005 Park et al.
2005/0138763 A1 6/2005 Tanner et al.
2006/0117520 A1 6/2006 Choi
2006/0123589 A1 6/2006 Kim
2007/0011842 A1 1/2007 Moon et al.

* cited by examiner 10
40
42
44
46
50
52
100
52a
54
102
29
62
36
32
34
60
30
74
76
70
72
28
22
14
20
84
80a
86
80
82

UPRIGHT VACUUM CLEANER WITH CYCLONIC AIR PATH

This application is a continuation of U.S. application Ser. No. 11/281,796, filed Nov. 18, 2005, now U.S. Pat. No. 7,228,592, which is a continuation of U.S. application Ser. No. 10/430,603, filed May 6, 2003, abandoned, which is a continuation of U.S. application Ser. No. 09/759,391, filed Jan. 12, 2001, now U.S. Pat. No. 6,910,245, which claims the benefit of U.S. Provisional Application Ser. No. 60/176,374, filed Jan. 14, 2000, the entire contents of which are incorporated herein by reference in their entirety.

FIELD OF THE INVENTION

This invention relates to an improved upright vacuum cleaner having a cyclonic air path. More particularly, this invention relates to such a vacuum cleaner as provides the operator with improved performance features such as a visual indication of the condition of a removable filter to allow for more timely cleaning of such filter, an improved filter insertion and removal arrangement that allows for easy maintenance, as well as other improvements as will be described below.

BACKGROUND OF THE INVENTION

In selecting a vacuum cleaner for home use, consumers today have many choices including a choice between an upright and a canister style vacuum cleaner, a choice between a bagged or a bag less dirt collection, and, a choice between a cyclonic versus a non-cyclonic cleaning action. Typically, two very important factors in the consumer's decision regarding the purchase of a vacuum cleaner are the ease of use of the vacuum cleaner and its cleaning effectiveness. Based on these factors, the bag less style of upright vacuum cleaner has become popular recently because it no longer requires the unpleasant task of periodically changing vacuum cleaner bags. Instead, the consumer merely removes the dust cup or container and empties it over a trash receptacle. Occasionally, the consumer must also clean out a removable filter within the dust cup that traps smaller particles of dirt. One of the problems associated with the task of emptying the dust cup is that the top of the dust cup is typically open to the air thus allowing that dust previously vacuumed, can be released back into the air during the process of transporting the dust cup to the trash receptacle.

Another feature of today's bagless vacuum cleaners is that the dust cup or container is typically made of clear plastic so that the operator can observe the cleaning action of the vacuum cleaner. This visual effect lets the operator monitor the effectiveness of the cleaning action and determine when the container should be emptied or the filter cleaned. Examples of such bagless upright vacuum cleaners can be found in U.S. Pat. Nos. 6,146,434; 6,070,291; and, 5,558,697. The problem with relying on this visual assessment of the cleaning action is that most consumers may not realize when the cleaning effectiveness has deteriorated by simply viewing the cleaning action. In fact, the cleaning effectiveness is also dependent upon the condition of any filtering devices disposed in the airflow path and if such filter is clogged or dirty, the cleaning effectiveness of the vacuum cleaner can be compromised without the operator being able to visually detect such condition. Accordingly, it would be beneficial if a bagless upright vacuum cleaner provided some additional means for determining the cleaning effectiveness particularly with respect to any filter devices that may be included with the bagless vacuum cleaner.

Of further importance in the operation of such bagless vacuum cleaners is the actual task of removing and reinstalling the dirt-collecting chamber so that the dirt can be emptied into a trash receptacle. Often times the operator has to make several attempts to align the dirt-collecting chamber properly for continued operation. It would be advantageous if the bagless vacuum cleaner included a simple and easy to use arrangement for aligning and reinstalling the dirt collecting chamber following a routine exercise of emptying the chamber.

SUMMARY OF THE INVENTION

One exemplary aspect of the present invention provides an upright suction cleaner having a floor engaging base unit, a body unit pivotally mounted on the base unit, a suction generating device disposed on the body unit, and a dirt separation system disposed on the body unit above the suction generating device. The dirt separation system has a first dirt separator and a second dirt separator, and the first dirt separator includes an air-pervious shroud having a plate that extends radially from the shroud. A working airflow path extends from the base unit, through the dirt separation system and into the suction generating device. A dirt collecting system is selectively mountable to the body unit, and includes a first chamber adapted to receive a first amount of dirt separated from the working airflow path by the first dirt separator and a second chamber adapted to receive a second amount of dirt separated from the working airflow path by the second dirt separator. The first and second chambers are located adjacent one another when mounted to the body unit. A tube forms part of the airflow path between the dirt separation system and the suction generating device. The tube is selectively mountable to the body unit adjacent the dirt collecting system. An elevator assembly is located below the dirt collecting system and includes a movable lever. The elevator assembly is adapted to raise to attach the dirt collecting system to the body unit when the movable lever is placed in a first position, and to lower to release the dirt collecting system from the body unit when the movable lever is placed in a second position. The first chamber, second chamber and tube are simultaneously visible to an operator when mounted to the body unit.

Another exemplary aspect of the present invention provides an upright suction cleaner having a floor engaging base unit, a body unit pivotally mounted on the base unit, a suction generating device disposed on the body unit, and a dirt separation system disposed on the body unit above the suction generating device. The dirt separation system has a first dirt separator and a second dirt separator. A working airflow path extends from the base unit, through the dirt separation system, and into the suction generating device. A dirt collecting system is selectively mountable to the body unit, and includes a first chamber adapted to receive a first amount of dirt separated from the working airflow path by the first dirt separator, and a second chamber adapted to receive a second amount of dirt separated from the working airflow path by the second dirt separator. The first and second chambers are located adjacent one another when mounted to the body unit. A tube forms part of the working airflow path between the dirt separation system and the suction generating device, and is selectively mountable to the body unit. An elevator assembly is located below the dirt collecting system and adapted to raise to attach the dirt collecting system to the body unit and lower to release the dirt collecting system from the body unit.

Another exemplary aspect of the present invention provides an upright suction cleaner having a floor engaging base unit, a body unit pivotally mounted on the base unit, a suction generating device disposed on the base unit or the body unit, and a dirt separation system disposed on the body unit. The dirt separation system has a first dirt separator and a second dirt separator. A working airflow path extends from the base unit, through the dirt separation system. and into the suction generating device. A dirt collecting system is selectively mountable to the body unit, and includes a first chamber adapted to receive a first amount of dirt separated from the working airflow path by the first dirt separator and a second chamber adapted to receive a second amount of dirt separated from the working airflow path by the second dirt separator. The first and second chambers are located adjacent one another when mounted to the body unit. A tube forms part of the working airflow path between the dirt separation system and the suction generating device. The tube is selectively mountable to the body unit adjacent the dirt collecting system. The first chamber, second chamber and tube are simultaneously visible to an operator when mounted to the body unit.

Another exemplary aspect of the present invention provides an upright suction cleaner having a floor engaging base unit, a body unit pivotally mounted on the base unit, a suction generating device disposed on the base unit or the body unit, and a dirt separation system disposed on the body unit. The dirt separation system has a first dirt separator and a second dirt separator. A working airflow path extends from the base unit, through the dirt separation system, and into the suction generating device. A dirt collecting system is selectively mountable to the body unit, and includes a first chamber adapted to receive a first amount of dirt separated from the working airflow path by the first cyclonic dirt separator, and a second chamber adapted to receive a second amount of dirt separated from the working airflow path by the second dirt separator. An elevator assembly is located below the dirt collecting system and adapted to raise to attach the dirt collecting system to the body unit and lower to release the dirt collecting system from the body unit.

Another exemplary aspect of the present invention provides an upright suction cleaner having a floor engaging base unit, a body unit pivotally mounted on the base unit, a suction generating device disposed on the body unit, and a dirt separation system disposed on the body unit above the suction generating device. The dirt separation system has a first cyclone separator. A working airflow path extends from the base unit, through the dirt separation system, and into the suction generating device. A dirt collecting system is selectively mountable to the body unit, and includes a first chamber adapted to receive a first amount of dirt separated from the working airflow path by the first cyclonic dirt separator. An elevator assembly is located below the dirt collecting system and has a movable lever. The elevator assembly is adapted to raise to attach the dirt collecting system to the body unit when the movable lever is placed in a first position, and to lower to release the dirt collecting system from the body unit when the movable lever is placed in a second position.

BRIEF DESCRIPTION OF THE DRAWINGS

The invention will now be more fully described with reference to the accompanying drawings in which.

DETAILED DESCRIPTION OF THE INVENTION

Figure 1:
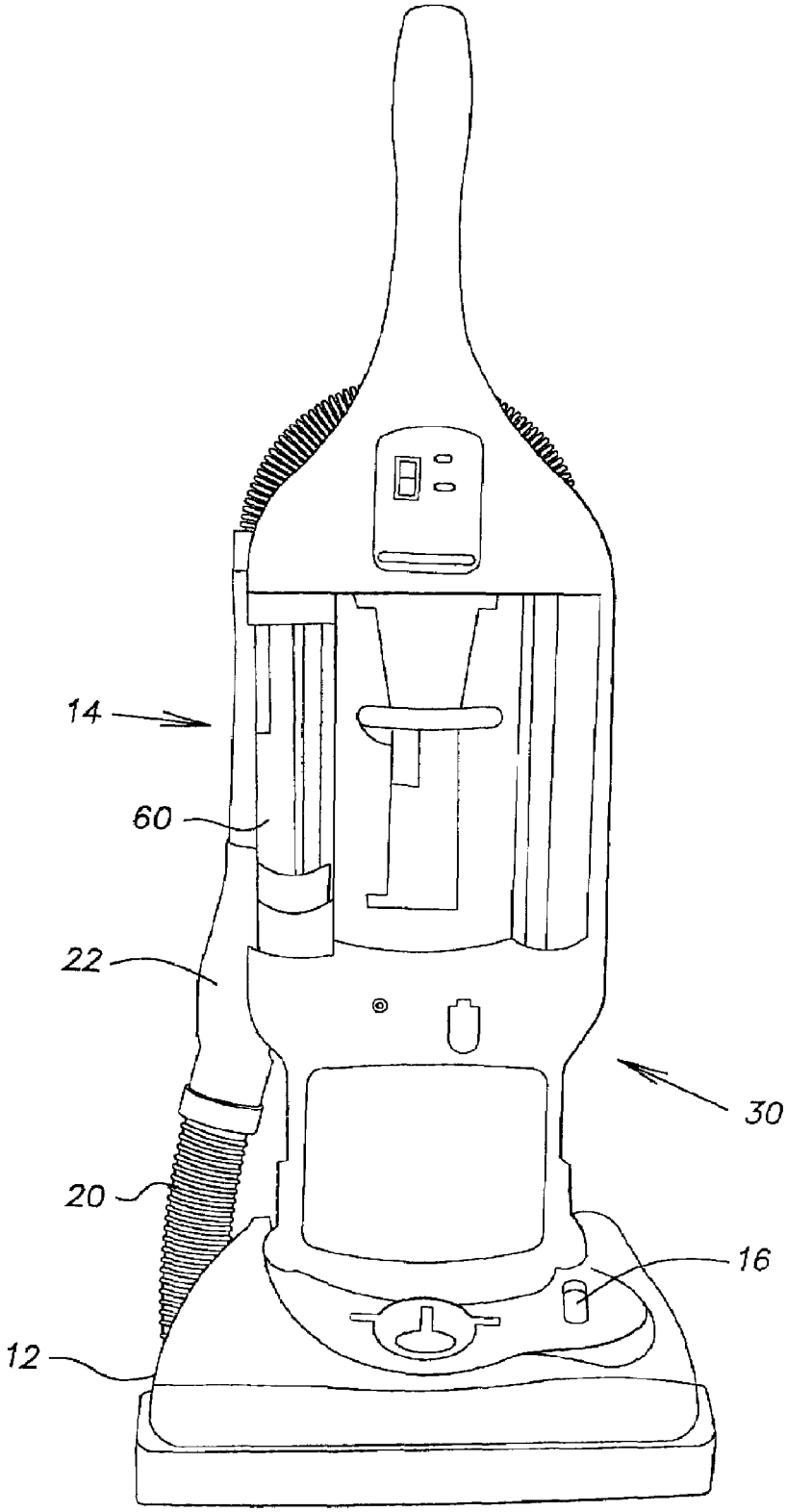
FIG. 1 is a perspective view of a front of the vacuum cleaner constructed in accordance with the present invention.

The present invention is directed toward an improved upright vacuum cleaner that has a plurality of cyclone filtration chambers and other mechanical filter means. The present invention uses progressive filtration wherein larger particles are removed first and then progressively smaller particles are removed from the air stream until, finally, very small particles are removed. As seen in FIG. 1, the vacuum cleaner of the present invention has a base 12, a rear housing 14 and an upstanding handle (see FIG. 3). The handle can be packaged separate and apart from the rear housing 14 and can be easily assembled by the user. The handle 10 includes a yoke or laterally split attachment arms that are inserted into accommodating recesses in the rear housing 14.

Figure 2:
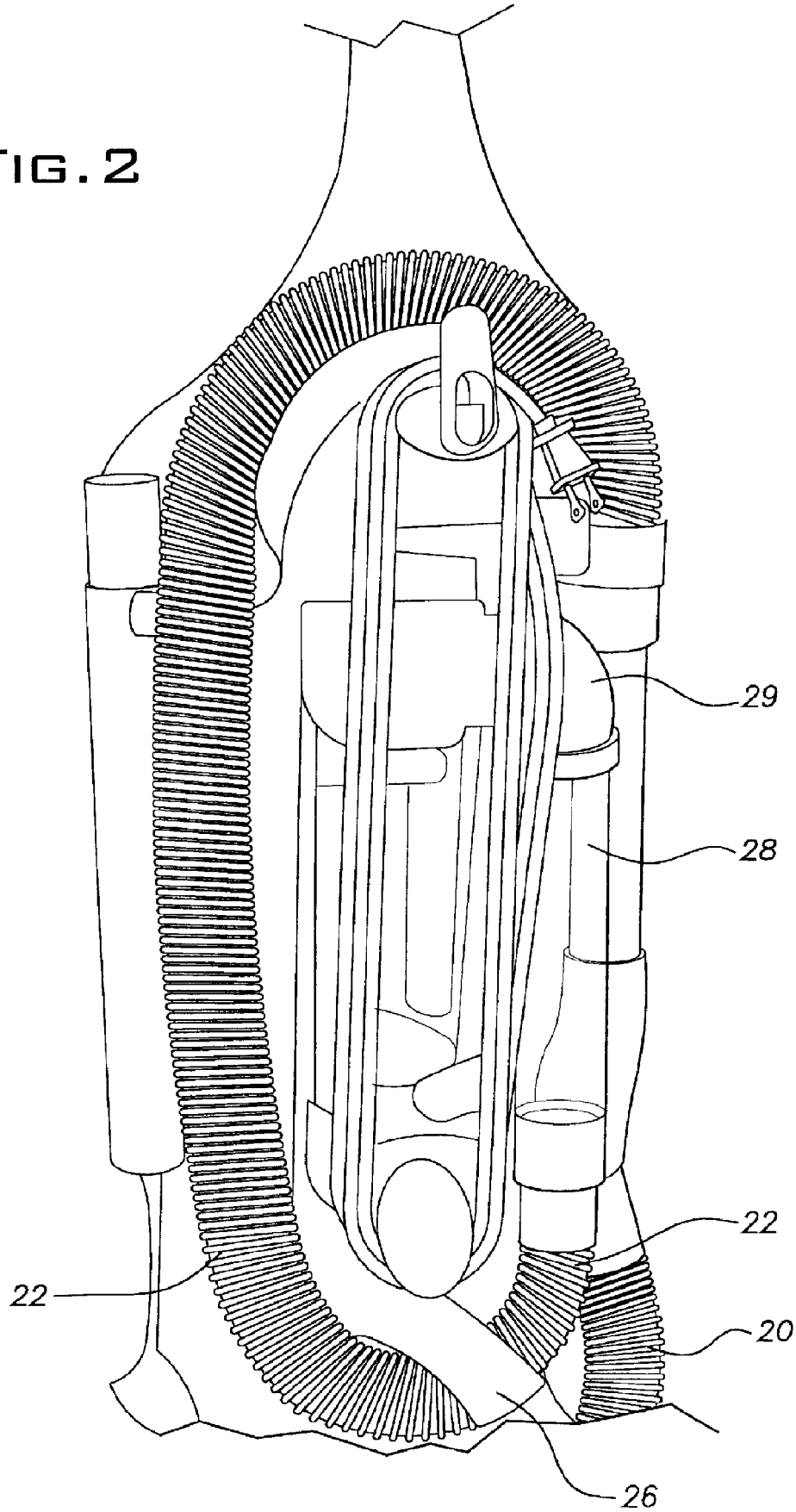
FIG. 2 is a perspective view of a rear of the vacuum cleaner constructed in accordance with the present invention.
Figure 3:
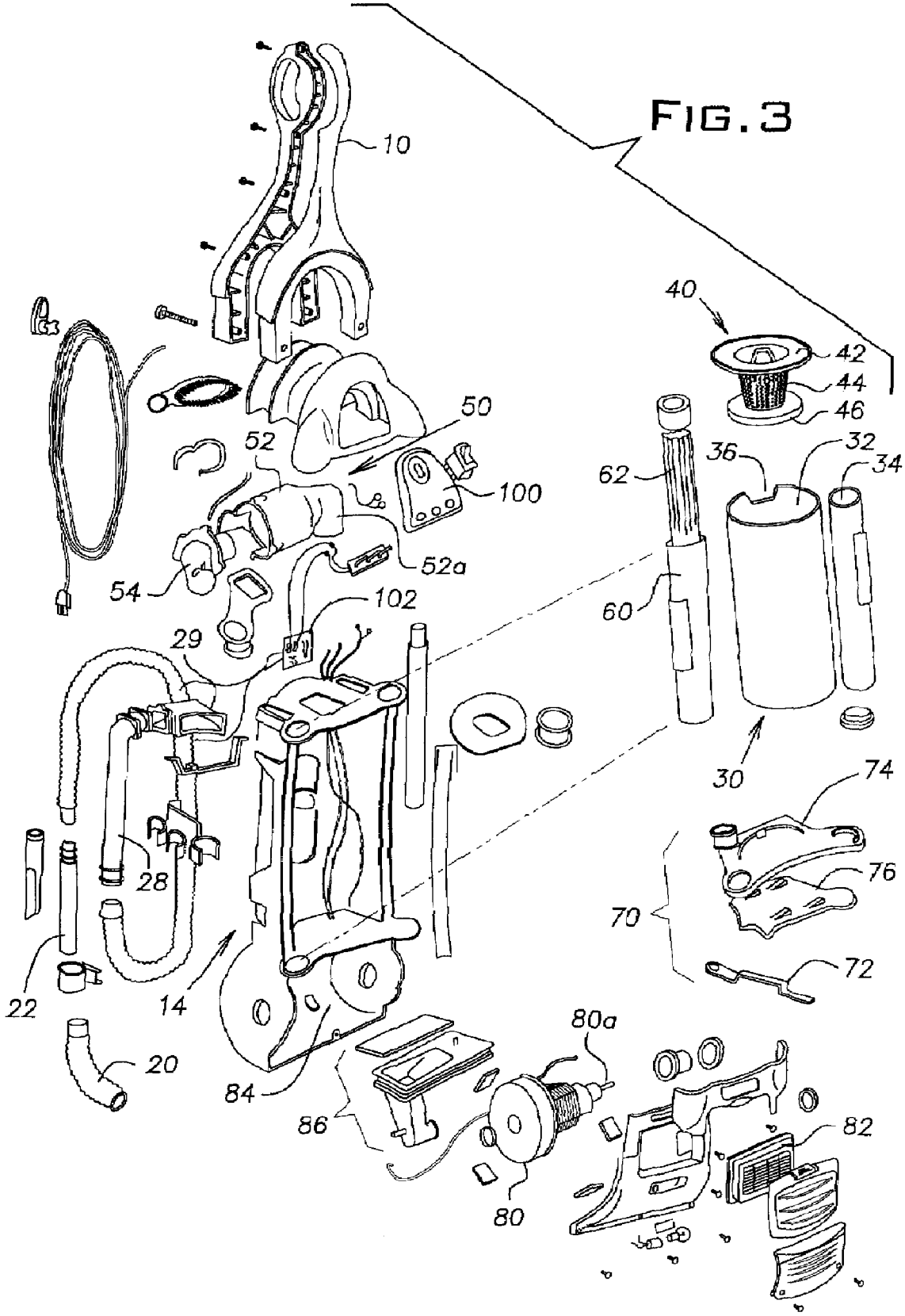
FIG. 3 is an exploded perspective view of the vacuum cleaner according to the present invention.

The base 12 includes a brush roll (not shown) that is selectively rotated by a drive belt (not shown), such brush roll and drive belt being constructed according to well known techniques. The drive belt is driven by a shaft 80*a* off of motor/fan assembly 80 as shown in FIG. 3. The motor can be disposed in a bottom portion of the rear housing 14, which is rotatably connected to the base 12. Additionally, the motor/fan assembly 80 can be disposed in a plenum chamber created by the air duct and rear housing/motor cover seal 86. The drive belt may be engaged/disengaged from the brush roll by operation of a pulley via a slide lever 16 to thereby disengage the brush roll as is desired when cleaning hard floor surfaces. As seen more clearly in FIG. 2, a tube 20 extends from the base 12 and communicates air and dirt upwardly from the base 12 to a hose 22. The hose 22 extends upwardly from the tube connection around a hose hook of a top rear portion of the rear housing 14 and down to the base of the rear housing 14 and under a hose retention member 26. The free end of the hose 22 connects to a first end of a conduit 28. The second end of the conduit 28 is connected to a dirt sensor housing 29.

The dirt sensor housing 29 extends from the conduit 28 to a rear portion of a dirt collecting enclosure 30 and acts as an input port so as to be sealingly engaged to the rear of the dirt collecting enclosure 30. The dirt sensor housing 29 can have gaskets molded or installed therein. Additionally, the dirt sensor housing 29 is formed having a bend therein so as to extend from a downwardly facing inlet to a laterally or horizontally facing outlet that is then connected to the rear portion of the dirt collecting enclosure 30. It would also be possible to achieve the benefits of the present invention if the inlet to the dirt sensor housing 29 were disposed in a horizontally; that is, oriented in the same manner as the horizontally facing outlet.

Figure 5:
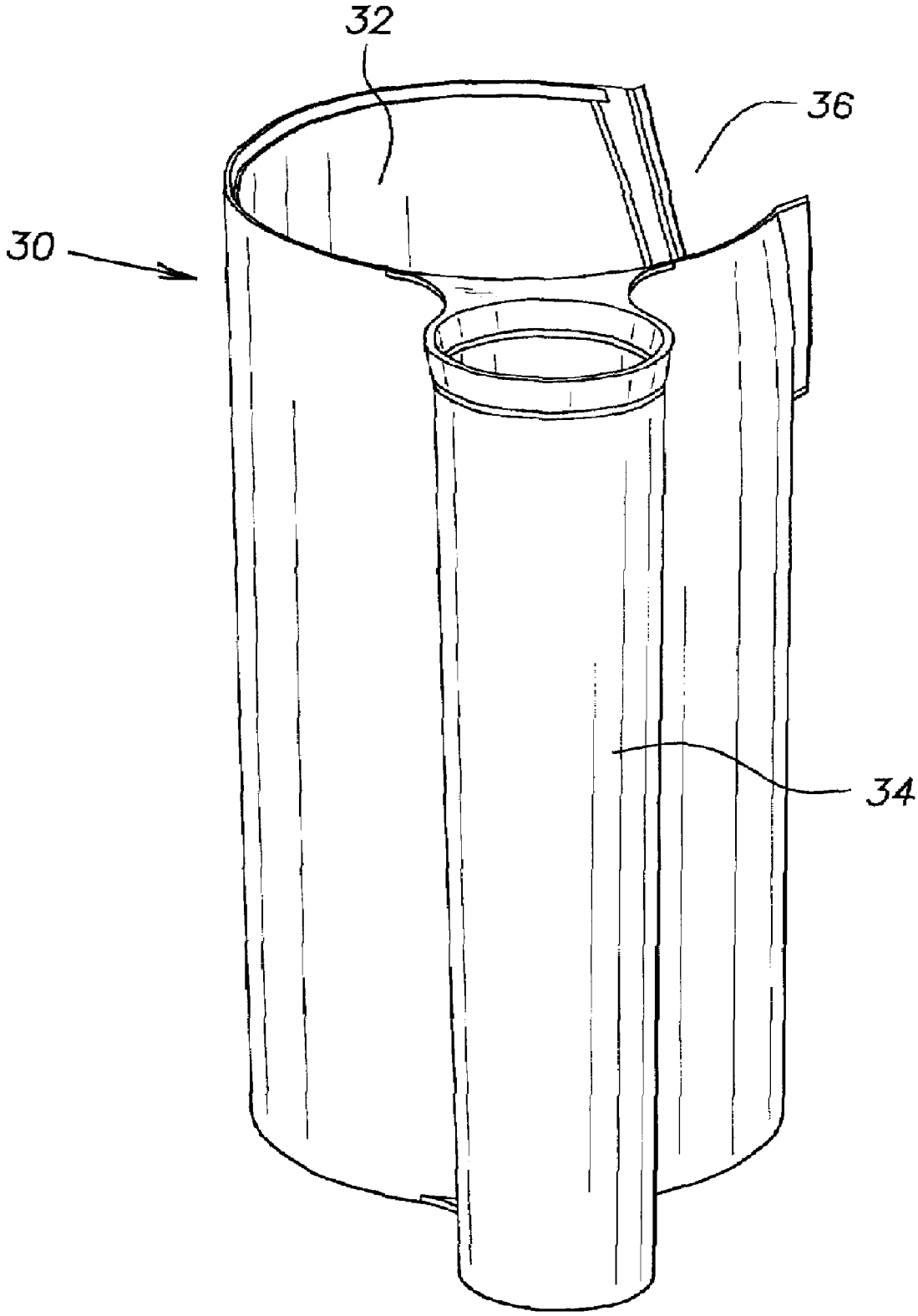
FIG. 5 is a perspective view of the dirt collecting enclosure portion of the present invention.

As seen in FIG. 5, the dirt collecting enclosure 30 has a first large chamber 32 and a smaller chamber 34. Air and dirt are introduced into the first large chamber 32 in a tangential manner to thereby achieve a cyclonic airflow. Each of the first and second chambers 32, 34 has an open upper end and a closed bottom side. The dirt sensor housing 29 sealingly engages a side of the large chamber 32 at a top end thereof and surrounds an input opening 36 to the large chamber 32. The input opening 36 is a notched opening at the top end of the first large chamber 32. Of course, the input opening to the first large chamber 32 can be disposed in the side of the large chamber 32 thereby allowing that the upper edge of the first large chamber is continuous about its circumference. An upper edge of the dirt collecting enclosure 30 at the first large chamber 32 includes a rim or ledge. A filter element 40 is disposed in the first large chamber 32 and is laterally adjacent the input opening 36.

Figure 6:
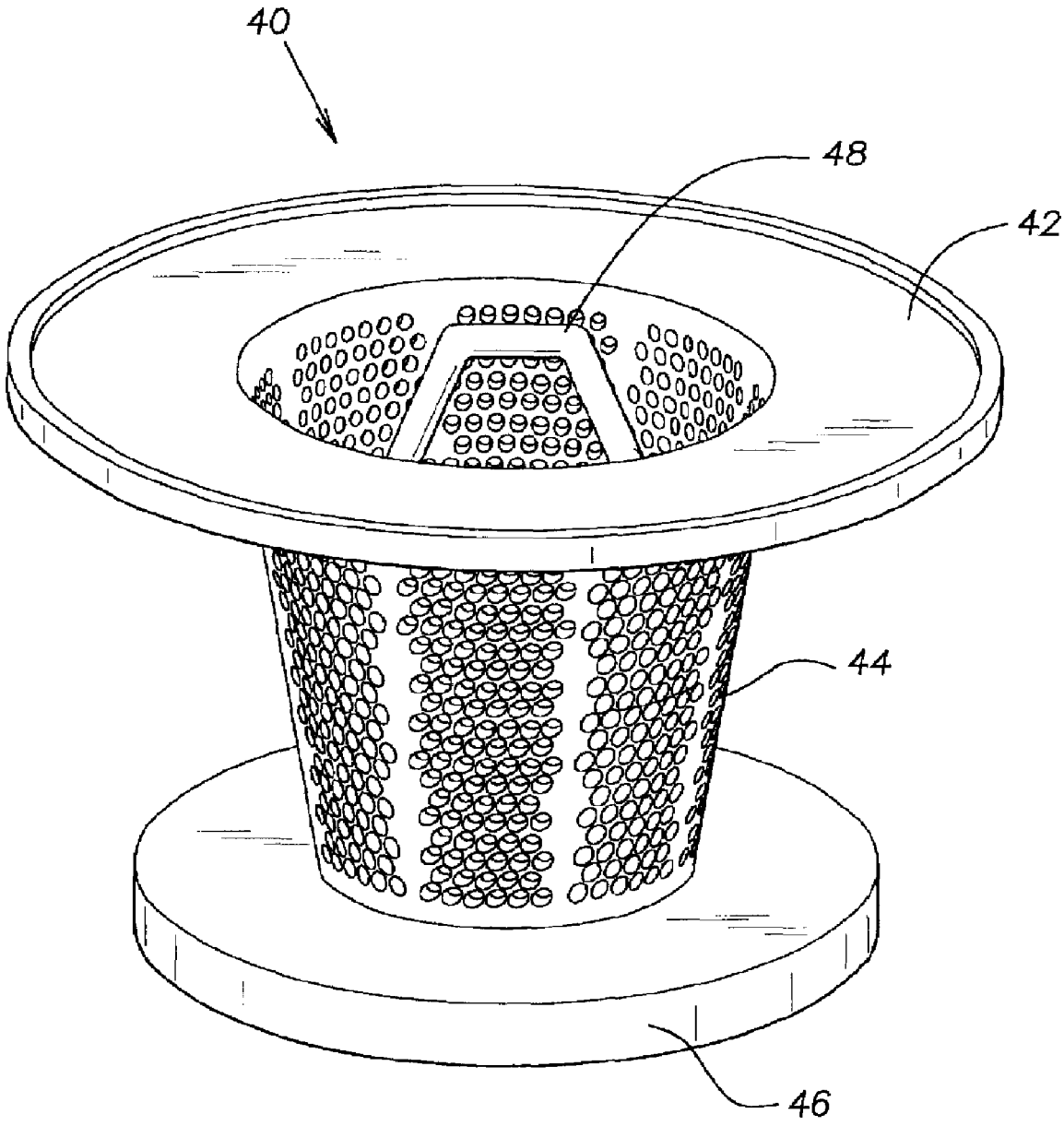
FIG. 6 is a perspective view of the filter element portion of the present invention.

As seen in FIG. 6, the filter element 40 includes an upper ring-shaped circular portion 42, a central frustoconical portion 44, and a lower ring-shaped portion 46. The upper ring-shaped portion 42 rests or is seated on the ring or ledge of the large first chamber 32 so that the body of filter 40 extends into the large first chamber 32. It should be noted that the upper ring-shaped portion 42 of filter 40 is effective for essentially closing off the large first chamber 32. This is particularly effective during the process of emptying the dirt collecting enclosure 30 in that the seating of the filter 40 of the upper opening of the first chamber 32 substantially reduces the occurrence of dirt escaping the dirt collecting enclosure 30 when the user is emptying the dirt collecting enclosure 30 into a trash receptacle. In this manner, the filter 42 acts as both a filter and a seal.

Figure 7:
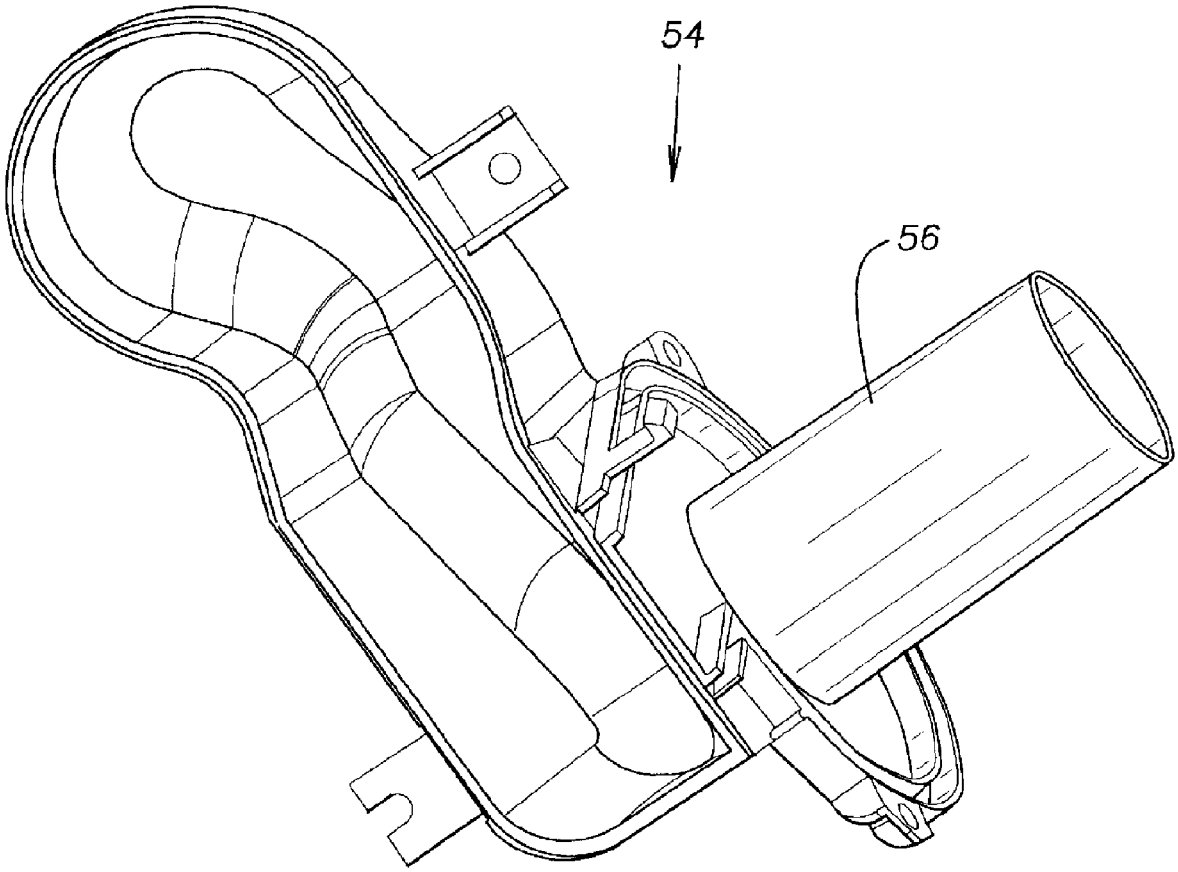
FIG. 7 is a perspective view of the end cap portion of the cyclone body of the present invention.
Figure 8:
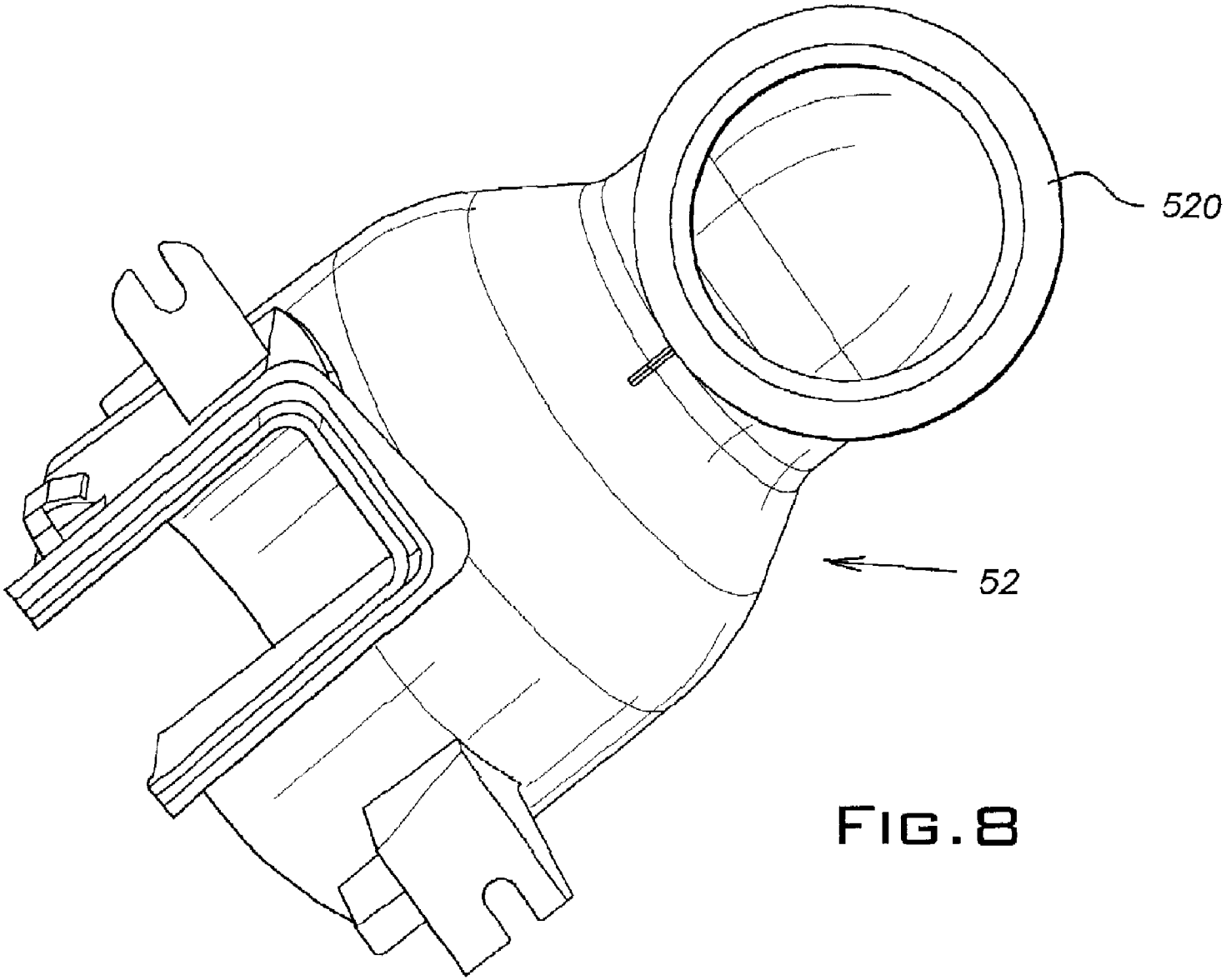
FIG. 8 is a perspective view of the cyclone body of the present invention.

The frustoconical portion 44 is perforated and serves as a filter surface. The lower ring shaped portion 46, which includes a downwardly extending peripheral flange, serves as a baffle plate and separator for larger particles that precipitate into the bottom of the first large chamber 32. Air from the first large chamber 32 flows through the filter member 40 and upwardly into a second cyclone 50 (see FIG. 3). The second cyclone is disposed relatively above the dirt collecting enclosure 30 and is operable to deposit or direct smaller dirt particles into the second chamber 34 of the dirt collecting enclosure 30. More specifically, relatively clean air from the first chamber 32 tangentially enters the second cyclone 50 and the cyclone chamber provided thereby via an inlet defined by the union of the cyclone body 52 and the cyclone end cap 54 (see FIGS. 7 and 8).

The cyclone body 52 includes a circular first body portion that merges into a downwardly extending tube portion 52*a*. The end of the tube portion 52*a* includes a flange and a neck, the neck extending into and sealing the second chamber 34 with the flange abutting the end face of the second chamber 34. Air is introduced tangentially into the second cyclone 50 and spirals around the neck and downwardly into the bottom of the second chamber 34 so as to carry the smaller particles of debris therewith. The clean air from the second chamber 34 exits via the outlet tube 56 provided by the cyclone end cap 54 and flows laterally across the vacuum cleaner body and into the top end of filter tube 60. The filter tube 60 is disposed substantially symmetrically on the opposite side of the first chamber 32 as the second chamber 34. More specifically, the air that enters a cylindrical filter member 62 disposed within filter tube 60, flows through the filter element 62 and exits via an outlet at the bottom of the filter tube 60. Air is communicated from the outlet of the filter tube 60 to the motor/fan assembly 80 and then to atmosphere via a HEPA filter 82.

As seen in FIG. 3, the vacuum cleaner includes an elevator assembly 70 that permits easy installation and sealing engagement of the dirt collecting enclosure 30 and filter tube 60 with the rear housing 14. The elevator assembly 70 is mounted to the rear housing 14 relatively beneath the dirt collecting enclosure 30 and filter tube 60 and includes a handle 72 that is laterally shifted or pivoted. Of course, other actuation mechanisms can be utilized as well and still achieve the benefits of the present invention. For instance, a rotatable knob can achieve the same actuation effect as the lever or handle 72. Movement of the handle 72 causes an elevator platform 74 to be moved up or down thereby either pushing the dirt collecting enclosure 30 and filter tube 60 up into sealing engagement with associated upper seals, or, permits the dirt collecting enclosure 30 and filter tube 60 to be dropped down and out of sealing engagement with the seals. Typically, the elevator assembly 70 will be moved to a lower position to permit removal of the dirt collecting enclosure 30 from the rear housing 14 for emptying, and will be moved to the upper position after the dirt collecting enclosure 30 and filter tube 60 are reinstalled to seal the assembly in position and permit further cleaning operations. A cam plate can also be provided as part of the elevator assembly 70 to achieve the raising and lowering functions. Of course, the cam operation need not be provided by a separate element but can be achieved by providing a camming surface on either the elevator platform 74 or the lever member 72. Additionally, though the present embodiment describes a mechanical arrangement for actuating the elevator, it is contemplated herein that the elevator arrangement could also be achieved by use of an electrical or pneumatic form of actuation.

The cyclone body 52 and cyclone end cap 54 cooperate to filter dirt from air and to transport clean air to another location of further processing. In this regard, it is important to note that the cyclone body 52 and the cyclone end cap 54 do not require a replaceable and removable filter element. The cyclone chamber defined by the cyclone body 52 is angled with respect to vertical, and extends downwardly and laterally from the upper end to the lower end. The lower end of the cyclone chamber bends still further downwardly such that the exit of the tube is essentially vertically oriented and therefore matches the orientation of the second chamber 34 and smoothly merges therewith.

The cyclone body 52 has a first edge adjacent its upper end that is engaged and sealed by the cyclone end cap 54. The cyclone end cap 54 preferably has a peripheral groove into which the first edge is inserted to form a labyrinth type seal. Naturally, additional sealing gaskets or seals may also be used. The connection between the cyclone end cap 54 and the cyclone body 52 also defines the inlet air passageway from the first chamber 32/filter element 40 to the second cyclone as noted hereinbefore. The end cap 52 and body 54 are also attached by cooperation of tabs and mechanical fasteners (not shown) about the first edge and the peripheral groove to ensure a sealing connection. The inlet passageway is generally tangential to the inner wall surface of the cyclone body 52, as illustrated.

Figure 4:
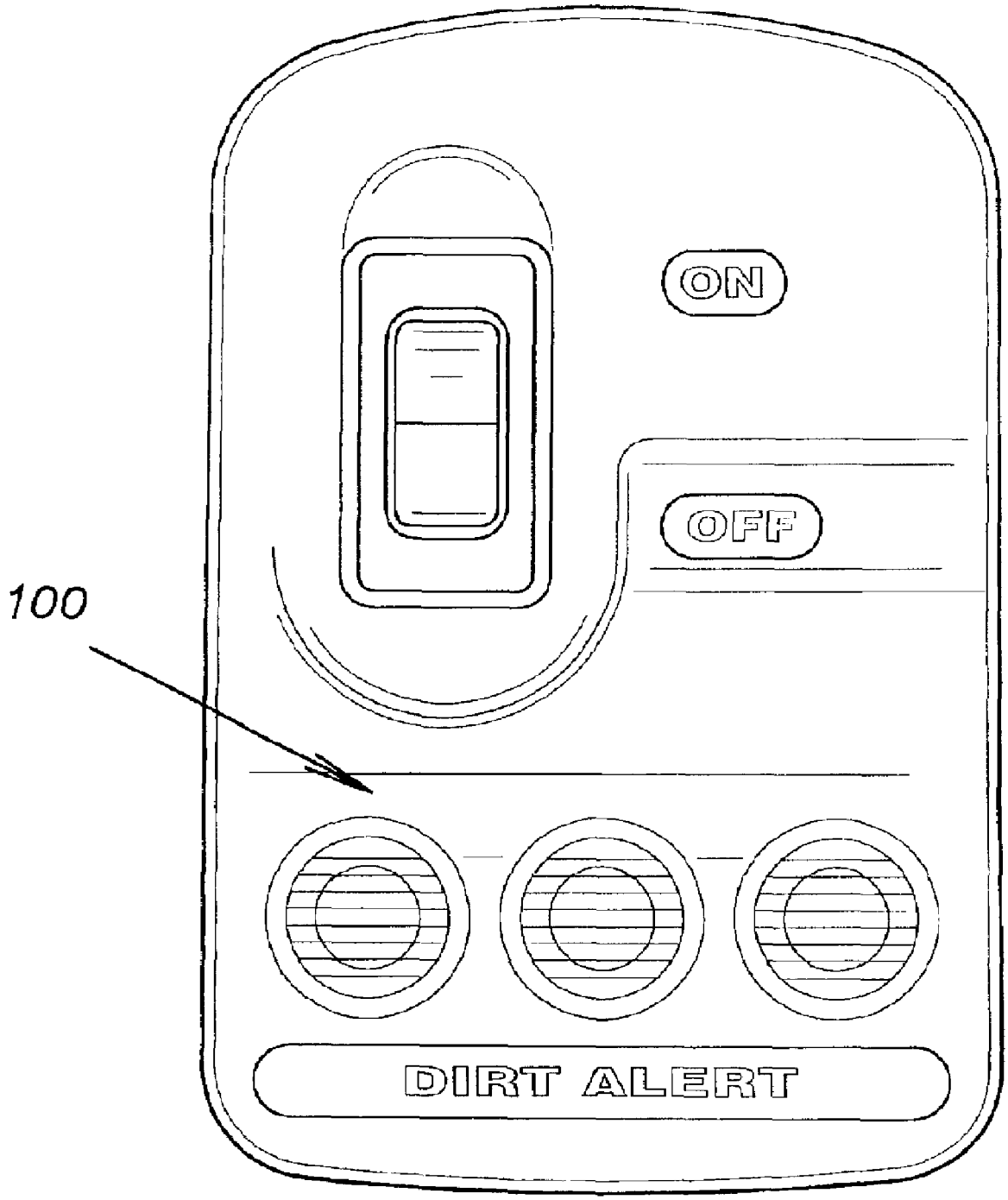
FIG. 4 is a front elevational view of a front of a vacuum cleaner showing dirt and filter condition indicators.

As seen in FIG. 4, adjacent the on-off switch, a series of indicators 100 are provided. The indicators can be LEDs that are illuminated to indicate the occurrence of a differential pressure across one or more of the filter elements, which is indicative of a clogged or dirty filter. The filter elements being sensed are preferably the HEPA filter and/or the tube filter element 62 downstream of the cyclone filter units. A circuit board 102 (see FIG. 3) with sensors extending therefrom into the airflow path, can perform the necessary detection and indication functions according to known techniques.

Although the hereinabove described embodiment of the invention constitutes the preferred embodiment; it should be understood that modifications could be made thereto without departing from the scope of the invention as set forth in the appended claims.

What is claimed is:

1. An upright suction cleaner comprising:

a floor engaging base unit;

a body unit pivotally mounted on the base unit;

a suction generating device disposed on the body unit;

a dirt separation system disposed on the body unit above the suction generating device, the dirt separation system comprising a first dirt separator and a second dirt separator, wherein the first dirt separator comprises an air-pervious shroud having a plate that extends radially from the shroud;

a working airflow path extending from the base unit, through the dirt separation system, and into the suction generating device;

a dirt collecting system selectively mountable to the body unit, the dirt collecting system comprising a first chamber adapted to receive a first amount of dirt separated from the working airflow path by the first dirt separator, and a second chamber adapted to receive a second amount of dirt separated from the working airflow path by the second dirt separator, the first and second chamber being located adjacent one another when mounted to the body unit;

a tube forming part of the working airflow path between the dirt separation system and the suction generating device, the tube being selectively mountable to the body unit adjacent the dirt collecting system; and an elevator assembly located below the dirt collecting system and comprising a movable lever, the elevator assembly being adapted to raise to attach the dirt collecting system to the body unit when the movable lever is placed in a first position, and to lower to release the dirt collecting system from the body unit when the movable lever is placed in a second position;

wherein the first chamber, the second chamber and the tube are simultaneously visible to an operator when mounted to the body unit.

2. An upright suction cleaner comprising:

a floor engaging base unit;

a body unit pivotally mounted on the base unit;

a suction generating device disposed on the body unit;

a dirt separation system disposed on the body unit above the suction generating device, the dirt separation system comprising a first dirt separator and a second dirt separator;

a working airflow path extending from the base unit, through the dirt separation system, and into the suction generating device;

a dirt collecting system selectively mountable to the body unit, the dirt collecting system comprising a first chamber adapted to receive a first amount of dirt separated from the working airflow path by the first dirt separator, and a second chamber adapted to receive a second amount of dirt separated from the working airflow path by the second dirt separator, the first and second chamber being located adjacent one another when mounted to the body unit;

a tube forming part of the working airflow path between the dirt separation system and the suction generating device, the tube being selectively mountable to the body unit; and an elevator assembly located below the dirt collecting system and adapted to raise to attach the dirt collecting system to the body unit and lower to release the dirt collecting system from the body unit.

3. The upright suction cleaner of claim 2, wherein the elevator assembly is further adapted to raise to attach the tube to the body unit and lower to release the tube from the body unit.

4. The upright suction cleaner of claim 2, wherein at least one of the first dirt separator and the second dirt separator comprises a cyclone separator.

5. The upright suction cleaner of claim 2, wherein the first chamber, the second chamber and the tube are simultaneously visible to an operator when mounted to the body unit.

6. An upright suction cleaner comprising:

a floor engaging base unit;

a body unit pivotally mounted on the base unit;

a suction generating device disposed on one of the base unit and the body unit;

a dirt separation system disposed on the body unit and comprising a first dirt separator and a second dirt separator;

a working airflow path extending from the base unit, through the dirt separation system, and into the suction generating device;

a dirt collecting system selectively mountable to the body unit, the dirt collecting system comprising a first chamber adapted to receive a first amount of dirt separated from the working airflow path by the first dirt separator, and a second chamber adapted to receive a second amount of dirt separated from the working airflow path by the second dirt separator, the first and second chamber being located adjacent one another when mounted to the body unit; and a tube forming part of the working airflow path between the dirt separation system and the suction generating device, the tube being selectively mountable to the body unit adjacent the dirt collecting system;

wherein the first chamber, the second chamber and the tube are simultaneously visible to an operator when mounted to the body unit.

7. The upright suction cleaner of claim 6, further comprising a single mechanism to simultaneously attach the dirt collecting system and the tube to the body unit.

8. The upright suction cleaner of claim 7, wherein the single mechanism comprises an elevator assembly located below the dirt collecting system and adapted to raise to attach the dirt collecting system to the body unit and lower to release the dirt collecting system from the body unit.

9. The upright suction cleaner of claim 6, wherein the tube is removable from the body unit separately from the dirt collecting system.

10. The upright suction cleaner of claim 6, wherein the second dirt separator receives the working airflow after it passes through the first dirt separator.

11. The upright suction cleaner of claim 6, wherein at least one of the first dirt separator and the second dirt separator comprises a filter element having an air-pervious shroud and a plate that extends radially from the air-pervious shroud.

12. The upright suction cleaner of claim 6, wherein the first dirt separator separates the first amount of dirt from the working airflow path by cyclonic separation, and the second dirt separator separates the second amount of dirt from the working airflow path by cyclonic separation.

13. The upright suction cleaner of claim 6, wherein the first chamber and the second chamber are joined to each other.

14. An upright suction cleaner comprising:

a floor engaging base unit;

a body unit pivotally mounted on the base unit;

a suction generating device disposed on one of the base unit and the body unit;

a dirt separation system disposed on the body unit and comprising a first dirt separator and a second dirt separator;

a working airflow path extending from the base unit, through the dirt separation system, and into the suction generating device;

a dirt collecting system selectively mountable to the body unit, the dirt collecting system comprising a first chamber adapted to receive a first amount of dirt separated from the working airflow path by the first dirt separator, and a second chamber adapted to receive a second amount of dirt separated from the working airflow path by the second dirt separator; and an elevator assembly located below the dirt collecting system and adapted to raise to attach the dirt collecting system to the body unit and lower to release the dirt collecting system from the body unit.

15. The upright suction cleaner of claim 14, wherein the elevator assembly comprises a cam plate, and the elevator assembly is mounted to the body unit.

16. The upright suction cleaner of claim 14, wherein the elevator assembly comprises a movable lever, the elevator assembly being raised when the movable lever is placed in a first position, and lowered when the movable lever is placed in a second position.

17. The upright suction cleaner of claim 14, wherein the second dirt separator is arranged to receive the working airflow after it passes through the first dirt separator.

18. The upright suction cleaner of claim 14, wherein at least one of the first dirt separator and the second dirt separator comprises a filter element having an air-pervious shroud and a plate that extends radially from the air-pervious shroud.

19. The upright suction cleaner of claim 14, wherein at least one of the first dirt separator and the second dirt separator comprises a frustoconical member that reduces in diameter at its lower end and a plate that extends radially from the frustoconical member.

20. The upright suction cleaner of claim 19, wherein the frustoconical member is air pervious.

21. The upright suction cleaner of claim 14, wherein the first chamber and the second chamber are located adjacent one another when mounted to the body unit.

22. An upright suction cleaner comprising:

a floor engaging base unit;

a body unit pivotally mounted on the base unit;

a suction generating device disposed on the body unit;

a dirt separation system disposed on the body unit above the suction generating device, the dirt separation system comprising a first cyclone separator;

a working airflow path extending from the base unit, through the dirt separation system, and into the suction generating device;

a dirt collecting system selectively mountable to the body unit, the dirt collecting system comprising a first chamber adapted to receive a first amount of dirt separated from the working airflow path by the first cyclone separator; and an elevator assembly located below the dirt collecting system and comprising a movable lever, the elevator assembly being adapted to raise to attach the dirt collecting system to the body unit when the movable lever is placed in a first position, and to lower to release the dirt collecting system from the body unit when the movable lever is placed in a second position.

23. The upright suction cleaner of claim 22, wherein the elevator assembly comprises an elevator platform.

24. The upright suction cleaner of claim 23, wherein the elevator assembly further comprises a cam plate adapted to raise and lower the elevator platform in response to movement of the movable lever.

25. The upright suction cleaner of claim 22, further comprising:

a tube forming part of the working airflow path between the dirt separation system and the suction generating device, the tube being selectively mountable to the body unit and having a filter located therein.

* * * * *